US009288890B1

(12) United States Patent
Chen et al.

(10) Patent No.: US 9,288,890 B1
(45) Date of Patent: Mar. 15, 2016

(54) METHOD AND APPARATUS FOR PROVIDING AN ANISOTROPIC AND MONO-ENERGETIC NEUTRAL BEAM BY NON-AMBIPOLAR ELECTRON PLASMA

(71) Applicant: Tokyo Electron Limited, Minato-ku (JP)

(72) Inventors: Lee Chen, Cedar Creek, TX (US); Merritt Funk, Austin, TX (US); Zhiying Chen, Austin, TX (US)

(73) Assignee: Tokyo Electron Limited, Minato-ku (JP)

( * ) Notice: Subject to any disclaimer, the term of this patent is extended or adjusted under 35 U.S.C. 154(b) by 0 days.

(21) Appl. No.: 14/530,349

(22) Filed: Oct. 31, 2014

(51) Int. Cl.
*H05H 3/02* (2006.01)
*H05H 3/00* (2006.01)

(52) U.S. Cl.
CPC ..... *H05H 3/02* (2013.01)

(58) Field of Classification Search
USPC ..... 250/251, 423 R, 424, 492.1, 492.2, 250/492.3, 492.21, 526; 438/710, 712, 714; 216/63, 67
See application file for complete search history.

(56) References Cited

U.S. PATENT DOCUMENTS

| | | | | |
|---|---|---|---|---|
| 7,732,759 | B2 * | 6/2010 | Chen | H01J 37/32357 216/67 |
| 7,772,544 | B2 * | 8/2010 | Chen | H05H 3/06 250/251 |
| 8,460,567 | B2 | 6/2013 | Chen | |
| 2009/0084501 | A1 * | 4/2009 | Chen | H01J 37/32357 156/345.26 |
| 2009/0090852 | A1 * | 4/2009 | Chen | H05H 3/06 250/251 |
| 2009/0236314 | A1 | 9/2009 | Chen | |
| 2009/0289179 | A1 * | 11/2009 | Chen | H01J 37/32357 250/251 |

* cited by examiner

*Primary Examiner* — Bernard E Souw
(74) *Attorney, Agent, or Firm* — Oblon, McClelland, Maier & Neustadt, L.L.P.

(57) ABSTRACT

Embodiments include a chemical processing apparatus and method of using the chemical processing apparatus to treat a substrate with a mono-energetic space-charge neutralized neutral beam-activated chemical process which is comprised of a substantially anisotropic beam of neutral particles. The chemical processing apparatus comprises a first plasma chamber for forming a first plasma at a first plasma potential, and a second plasma chamber for forming a second plasma at a second plasma potential greater than the first plasma potential, wherein the second plasma is formed using electron flux from the first plasma. Further, the chemical processing apparatus comprises an ungrounded dielectric (insulator) neutralizer grid configured to expose a substrate in the second plasma chamber to the substantially anisotropic beam of neutral particles traveling from the neutralizer grid.

20 Claims, 14 Drawing Sheets

METHOD AND APPARATUS FOR PROVIDING AN ANISOTROPIC AND MONO-ENERGETIC NEUTRAL BEAM BY NON-AMBIPOLAR ELECTRON PLASMA

BACKGROUND

1. Field of the Disclosure

This disclosure relates to a plasma-based method and apparatus for treating a substrate. In particular, the disclosure relates to a plasma-based method and apparatus for generating a neutral beam of particles for performing an anisotropic and mono-energetic neutral beam activating chemical processing of a substrate by applying a non-ambipolar electron plasma in a low-pressure environment.

2. Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

During semiconductor processing, plasma is often utilized to assist etch processes by facilitating the anisotropic removal of material along fine lines or within vias (or contacts) patterned on a semiconductor substrate. Examples of such plasma assisted etching include Reactive Ion Etching (RIE), which is in essence an ion activated chemical etching process.

However, although RIE has been in use for decades, its maturity is accompanied by several issues including: (a) broad ion energy distribution (IED), (b) various charging-induced side effects; and (c) feature-shape loading effects, that is, micro loading. One approach to alleviate these problems is to utilize neutral beam processing as described in commonly owned or assigned, U.S. Pat. Pub. 2009/0236314, herein incorporated by reference.

A true neutral beam process takes place essentially without any neutral thermal species participating as the chemical reactant, additive, and/or etchant. The chemical process, such as an etching process, at the substrate is activated by the kinetic energy of the incident (directionally energetic) neutral species and the incident (directionally energetic and reactive) neutral species also serve as the reactants or etchants.

One natural consequence of neutral beam processing is the absence of micro loading since the process does not involve the effect of flux-angle variation associated with the thermal species (which serve as the etchants in RIE). However, an adverse consequence of the lack of micro loading is the achievement of an etch efficiency of unity, that is, the maximum etching yield is unity, or one incident neutral nominally prompts only one etching reaction. Conversely, the abundant thermal neutral species (the etchant) in RIE can all participate in the etching of the film, with the activation by one energetic incident ion. Kinetic energy activated (thermal neutral species) chemical etching can therefore achieve an etch efficiency of 10, 100 and even 1000, while being forced to live with micro loading.

Current neutral beams may use, for example, a turbo-molecular pump (TMP) utilizing a rather unreasonable 10,000 liters/second (l/s) flow rate placed upon delicate substrates, for example, 300 mm wafer substrates.

FIG. 1 is a schematic view of a conventional neutral beam (NB) source 10 where a neutralizer grid 20 is at ground. FIG. 1 describes the pumping difficulty of the conventional neutral beam (NB) source. In other words, where the TMP or turbo 28 is high, for example, 10,000 liters/second (l/s), when a thin wafer substrate 26, for example 300 mm wafer substrate, is exposed to the same, the wafer substrate may fail or break. In FIG. 1, NB source 10 may include a first plasma chamber 16 for forming a first plasma 18 at a first plasma potential ($V_{P,1}$) at approximately 10 millitorr (mTorr), and a second plasma chamber 22 for forming a second plasma 24 at a second potential ($V_{P,2}$) at approximately $1\times10^{-4}$ to $5\times10^{-5}$ Torr and the second potential is greater than the first plasma potential. The first plasma 18 is formed by coupling power, such as radio frequency (RF) or microwaves (μ-wave) at 12, to an ionizable gas, for example, argon (Ar) gas, in the first plasma chamber 16 via a gas injector inlet 14, while the second plasma 24 is formed using electron flux passing through the neutralizer grid 20 from the first plasma 18.

The first plasma chamber 16 comprises a plasma generation system 12 configured to ignite and heat the first plasma 18. The first plasma 18 may be heated by any conventional plasma generation system including, but not limited to, an inductively coupled plasma (ICP) source, a transformer coupled plasma (TCP) source, a capacitively coupled plasma (CCP) source, an electron cyclotron resonance (ECR) plasma source, a helicon wave plasma source, a surface wave plasma source, a surface wave plasma source having a slotted plane antenna, and the like. Although the first plasma 18 may be heated by any plasma source, it is desired that the first plasma 18 is heated by a method that produces a reduced or minimum fluctuation in its plasma potential ($V_{P,1}$). For example, an ICP source is a practical technique that produces a reduced or minimum ($V_{P,1}$) fluctuation (see U.S. Pat. Pub. 2009/0236314).

FIG. 2 is a graphical plot showing a potential diagram and geometry 30 of an accelerator surface 32 and a grounded neutralizer grid top surface 34 using a conventional neutral beam (NB) source of a mono energetic type of FIG. 1. In this type, the accelerator surface 32 of a mono-energetic NB has to be direct current (DC) powered ($+V_A$). In FIG. 2, a plasma bulk 36 has a plasma potential ($V_P$) or boundary-driven plasma potential, as driven up by the positively biased DC accelerator surface 32, where $V_P \sim V_A$. It should be noted that the accelerator surface 32 has a surface area substantially greater than the surface area of the neutralizer grid top surface 34. Further, the potential diagram and geometry 30 also shows a sheath S comprising a classical pre-sheath $S_A$ governing the ion Bohm velocity and the initial ion flux, a sheath edge 38, and an electron-free region 40 or cathode fall $S_B$, where the total sheath $S=S_A+S_B$.

It should be noted that the DC biased accelerator surface 32 comprises a relatively large area in contact with the plasma bulk 36. The larger the area at DC ground, the lower the first plasma potential. For example, the surface area of the conductive surface for the DC biased accelerator surface 32 in contact with the plasma bulk 36 may be greater than any other surface area in contact with the plasma bulk 36.

Additionally, for example, the surface area of the conductive surface for the DC biased accelerator surface 32 in contact with the plasma bulk 36 may be greater than the total sum area of all other conductive surfaces that are in contact with the plasma bulk 36.

Alternatively, as an example, the conductive surface for the DC biased accelerator surface 32 in contact with the plasma bulk 36 may be the only conductive surface that is in contact with the plasma bulk 36. The DC biased accelerator surface 32 may offer the lowest impedance path to ground.

While many attempts have been made to cure these shortcomings, that is, etch efficiency, micro loading, charge damage, TMP flow rates, and/or tradeoffs between these parameters, they still remain and the etch community continues to explore novel, practical solutions to this problem.

SUMMARY

Embodiments may include a method for treating a substrate. The method includes disposing a substrate in a chemical processing apparatus configured to treat the substrate with plasma products. The method also includes flowing a first process gas at a first pressure into a first plasma region of a plasma generation chamber of the chemical processing apparatus and maintaining a first plasma in the first plasma region at a first plasma potential. The method further includes flowing a second process gas at a second pressure into a second plasma region of the plasma generation chamber and maintaining a second plasma in the second plasma region at a second plasma potential by using a DC accelerator that maintains the second plasma potential sufficiently greater than the first plasma potential such that the second plasma potential causes an electron flux from the first plasma region towards the second plasma region, the second plasma being maintained using the electron flux from the first plasma region, the second plasma region being separated from the first plasma region via a separation member disposed there between, the separation member defining an array of openings sufficient to allow the electron flux from the first plasma region to the second plasma region. The method also includes accelerating positive ions from the second plasma region towards a neutralizer grid disposed between the substrate and the second plasma region, the positive ions being accelerated by maintaining the second plasma such that the second plasma has a potential drop across a sheath boundary adjacent to the neutralizer grid, the neutralizer grid defining a plurality of channels oriented perpendicular to a surface of the substrate, a surface material of the plurality of channels being a material that temporarily holds electrons from the electron flux on surfaces of the plurality of channels such that positive ions traveling through the neutralizer grid receive electrons from the surfaces of the plurality of channels and continue traveling toward the substrate as a neutral particle. The method further includes exposing the substrate to a substantially anisotropic beam of neutral particles traveling from the neutralizer grid.

Embodiments may also include a method for treating a substrate. The method includes disposing a substrate in a plasma processing apparatus configured to treat the substrate with plasma products and flowing a first process gas at a first pressure into a first plasma region of a plasma generation chamber of the plasma processing apparatus. The method also includes maintaining a first plasma in the first plasma region at a first plasma potential using a first energy source and flowing a second process gas at a second pressure into a second plasma region of the plasma generation chamber. The method further includes maintaining a second plasma in the second plasma region at a second plasma potential by using a DC accelerator, using the DC accelerator includes maintaining the second plasma potential sufficiently greater than the first plasma potential such that the second plasma potential causes an electron flux from the first plasma region towards the second plasma region, the second plasma being maintained using the electron flux from the first plasma region, the second plasma region being separated from the first plasma region via a separation member disposed there between, the separation member defining an array of openings sufficient to allow the electron flux from the first plasma region to the second plasma region. The method also includes controlling power to the DC accelerator such that the second plasma develops a plasma sheath potential that creates a plasma beam directed towards a neutralizer grid disposed between the substrate and the second plasma region, the plasma beam being space-charge-neutral by having approximately equal amounts of electrons and positive ions, the neutralizer grid defining a plurality of channels oriented perpendicular to a surface of the substrate, a surface material of the plurality of channels being a dielectric material that temporarily holds electrons from the plasma beam on surfaces of the dielectric material such that positive ions from the plasma beam traveling through the neutralizer grid receive electrons and continue traveling toward the substrate as a neutral particle. The method further includes exposing the substrate to a substantially anisotropic beam of neutral particles traveling from the neutralizer grid.

Embodiments may further include an apparatus for treating a substrate. The apparatus includes a first plasma chamber for forming a first plasma at a first plasma potential. The apparatus also includes a second plasma chamber for forming a second plasma at a second potential greater than the first plasma potential. The second plasma is formed and maintained by using electron flux from the first plasma and being coupled to a DC accelerator. The apparatus further includes a separation member disposed between the first plasma chamber and the second plasma chamber, wherein the separation member is configured with an array or openings sufficient to allow the electron flux from the first plasma chamber to enter the second plasma chamber. The apparatus also includes a holder disposed adjacent to the second plasma chamber and apart from the separation member. The holder is configured to hold a neutralizer grid defining a plurality of channels oriented perpendicular to a surface of the substrate, a surface material of the plurality of channels being a material that temporarily holds electrons from the electron flux on surfaces of the plurality of channels such that positive ions traveling through the neutralizer grid receive electrons from the surfaces of the plurality of channels and continue traveling toward the substrate as a neutral particle. The neutralizer grid is configured to cause a substantially anisotropic beam of neutral particles traveling from the neutralizer grid via the electron flux.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
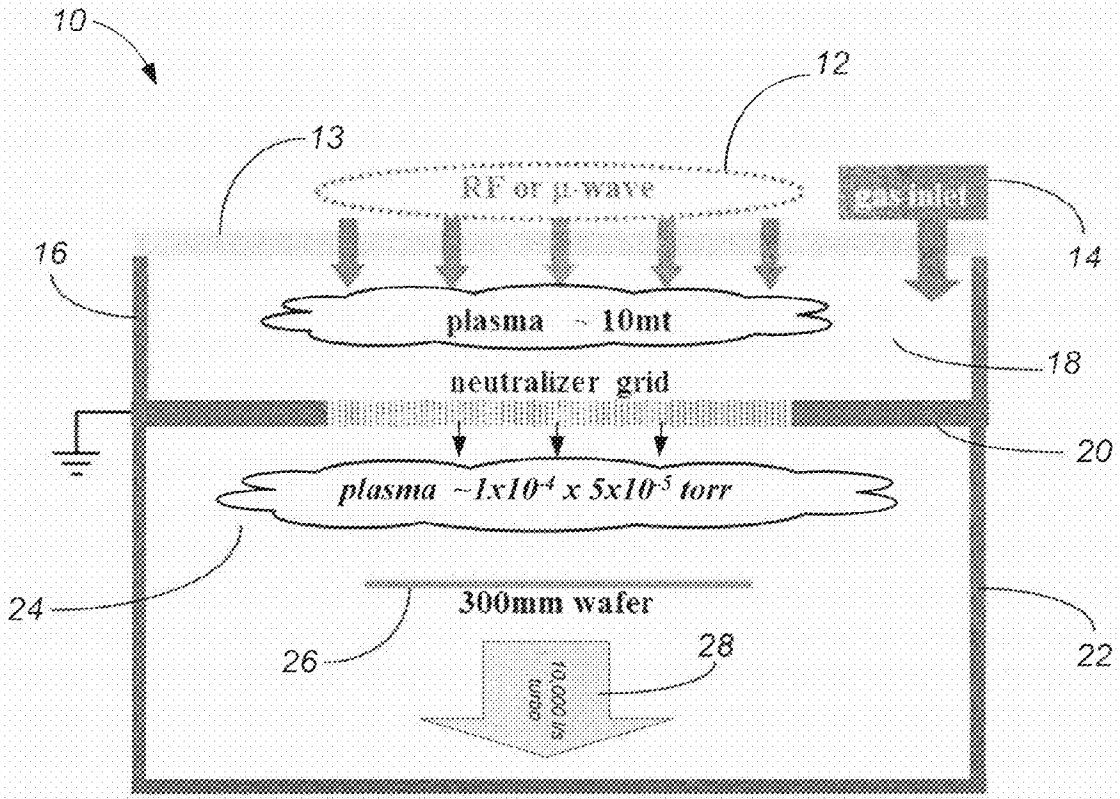
FIG. 1 (background art)
FIG. 1 is a schematic view of a conventional neutral beam (NB) source where a neutralizer grid is at ground.

Referring now to the drawings, wherein like reference numerals designate identical or corresponding parts throughout the several views.

According to one embodiment, a method and apparatus for providing an anisotropic and mono-energetic neutral beam (NB) by non-ambipolar electron plasma (NEP) which may activate chemical processing of a substrate is provided, among other things, to alleviate some or all of the above identified issues. Neutral beam activated chemical processing by a non-ambipolar electron plasma includes kinetic energy activation, that is, thermal neutral species and, hence, it achieves high reactive or etch efficiency. However, neutral beam activated chemical processing, as provided herein, also provides the ability to achieve mono-energetic activation, space-charge neutrality, hardware practicality, and to allow for a more reasonable lower turbo-molecular pressure (TMP) at the substrate.

In order to provide a more reasonable TMP flow rate of about 2,200 l/s or 3,300 l/s, for example, to be used on a wafer substrate of about 300 mm, a neutral beam (NB) source may be provided that is: (1) a plasma-based NB source configured to provide the lowest pressure plasma for enabling the lowest pumping (TMP) requirement, (2) the highest NB electron flux, (3) directional (anisotropic) with controllable energy, (4) a mono-energetic NB, (5) a neutralizer grid material which may be an insulator (instead of being a conductor) such as quartz ($SiO_2$), ceramic ($Al_2O_3$), bulk $HfO_2$, bulk $Y_2O_3$, and the like.

Figure 2:
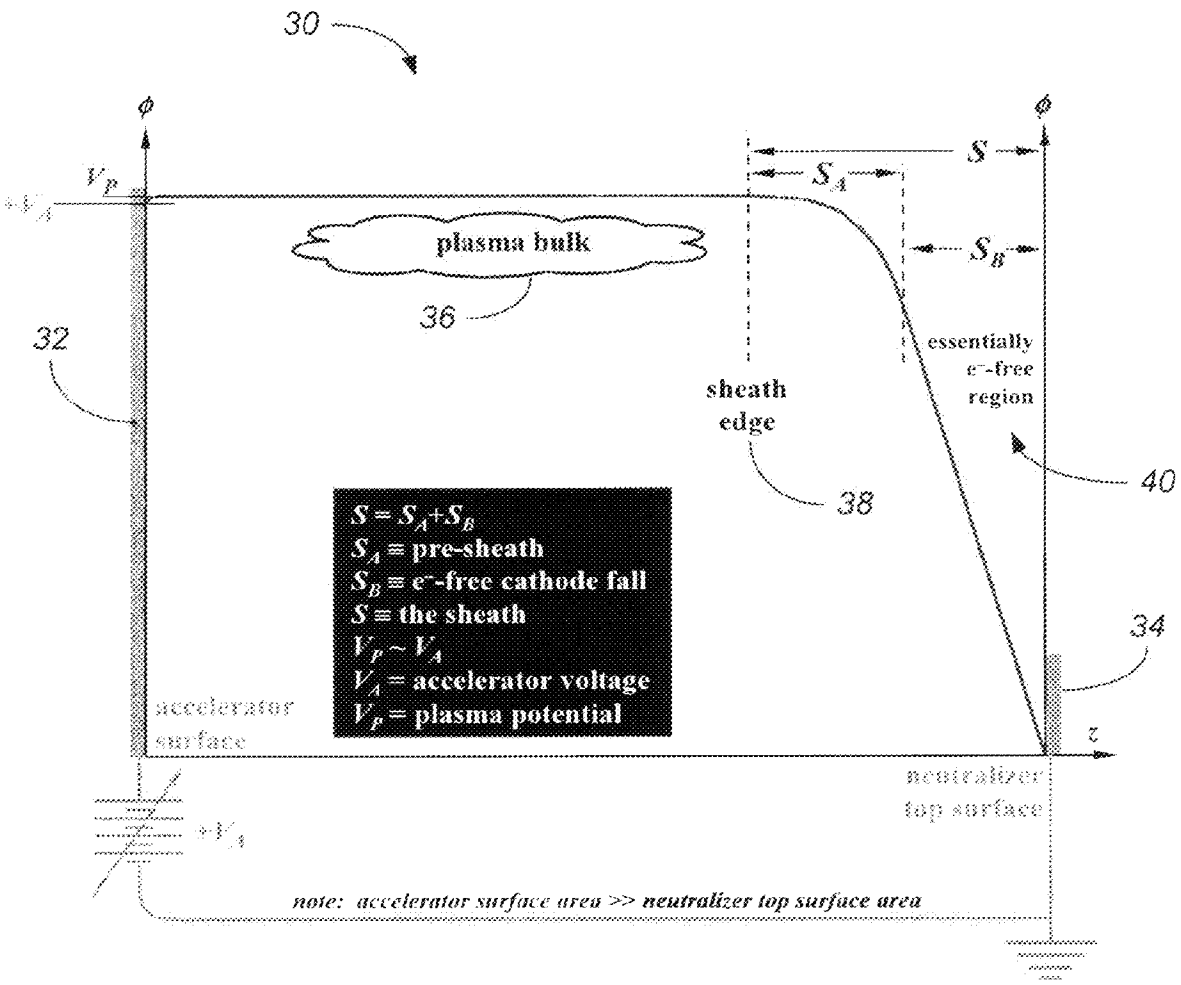
FIG. 2 (background art)
FIG. 2 is a graphical plot showing a potential diagram and geometry of an accelerator surface and a grounded neutralizer grid top surface using the conventional neutral beam source of a mono energetic type of FIG. 1.

FIGS. 1 and 2, discussed above, show a conventional neutral beam (NB) source where a neutralizer grid is at ground and the associated potential diagram and geometry of the same using the conventional neutral beam source of a mono energetic type.

Figure 3:
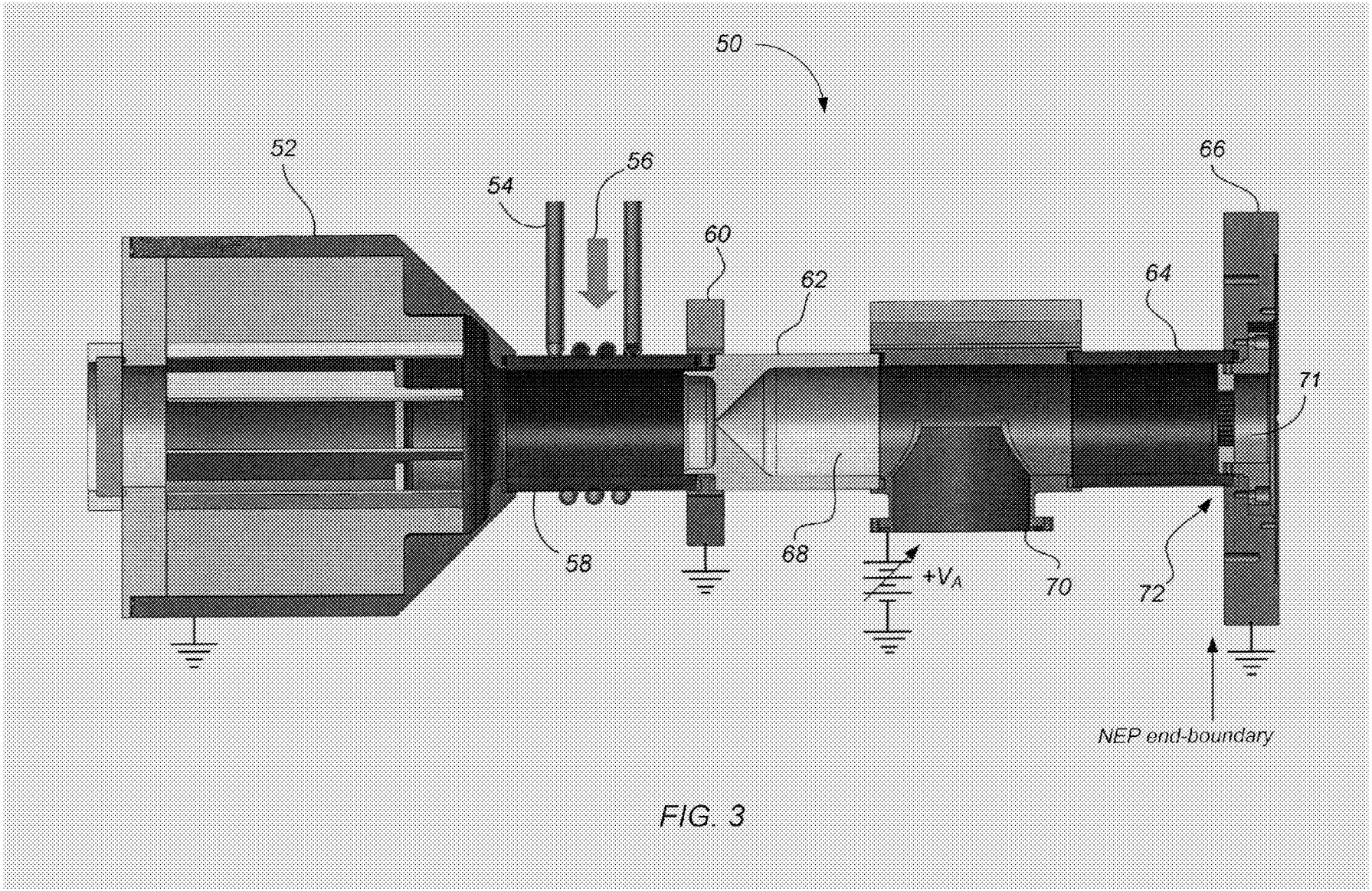
FIG. 3 is an illustrative view of a chemical processing apparatus according to certain embodiments of the disclosure.

FIG. 3 is an illustrative view of an example embodiment of a chemical processing apparatus, for example, a one-injector neutral beam (NB) non-ambipolar electron plasma (NEP) apparatus 50 (NB-NEP) according to certain embodiments of the disclosure. In FIG. 3, in general, the dielectric injector 68 of the NB-NEP apparatus 50 may have an array of injector nozzles or openings (not shown) to allow the electron flux from the first plasma dielectric chamber 58 to the second plasma dielectric chamber 64. In FIG. 3, a single nozzle electron injector 68 (called one-injector) NEP is used as an example embodiment. The NB-NEP apparatus 50 volume is comparably small, for example, approximately 4 cm in diameter. The potential structure of the NB-NEP apparatus 50 is important (see FIGS. 9 and 10). There is an injector double layer which is concluded (see FIGS. 9 and 10). A NEP end-boundary may exist where a wafer substrate, a neutralizer grid or, a detector may be disposed (see FIG. 3). It is important that there is no electrical ground touching the NEP; only the plasma-1 has direct current (DC)-ground. Such DC-ground area should be substantially large when compared to the cross section area of the electron injector nozzle 68. Therefore, the NEP end-boundary is in effect, an insulator surface (at 72 in FIG. 3, for example).

The one-injector NB-NEP apparatus 50 may include a ground can 52 configured as an electrical ground reference, a first plasma dielectric tube/chamber 58, an injector dielectric portion 62 containing, for example, the dielectric injector 68 having, for example, a 90°-cone injector coupled to an accelerator 70, a second plasma dielectric tube/chamber 64 configured to isolate the accelerator 70 from ground, a ground mounting flange 66 configured as an electrical ground, a dielectric grid holder 71, and a dielectric neutralizer grid 72 or wafer substrate. The NEP end-boundary may be disposed at the neutralizer grid (separation member) 72 or wafer substrate, as discussed above. Alternatively, a second ground flange may be disposed between the first plasma dielectric chamber 58 and the injector dielectric portion 62.

The first plasma dielectric tube/chamber 58 may comprise quartz ($SiO_2$), $Al_2O_3$, or the like and may include a first plasma power source 54, 56 comprising a helical resonator, inductively coupled plasma (ICP), hollow cathode, etc. For example, first plasma dielectric tube/chamber 58 may be an ICP quartz tube. The injector dielectric portion 62 may be quartz ($SiO_2$), $Al_2O_3$, or the like and the second plasma power source may comprise the accelerator 70 coupled to the injector dielectric portion 62 and the second plasma dielectric tube/chamber 64. Further, the injector dielectric portion 62 may be a NEP quartz tube. The second plasma dielectric tube/chamber 64 may comprise quartz ($SiO_2$), $Al_2O_3$, or the like. Thus, the second plasma dielectric may be a quartz tube, for example. The first plasma may be any efficient plasma source having a high-$n_e$ electron source and the plasma being inert, where $n_e$ is electron number density. The pressure, P, within the first plasma dielectric tube/chamber 58 may be as follows: $1\times10^{-5}<P<1\times10^{-1}$ Torr. The pressure, P, within the second plasma dielectric tube/chamber 64 may be as follows: $1\times10^{-5}<P<1\times10^{-2}$ Torr. Thus, both the first plasma and second plasma may be low pressure plasmas ensuring a reasonable substrate pressure or interaction. Alternatively, the first plasma dielectric tube/chamber 58 and the injector dielectric portion 62 may be combined as one-body with the injector nozzle 68 disposed in between.

Figure 4:
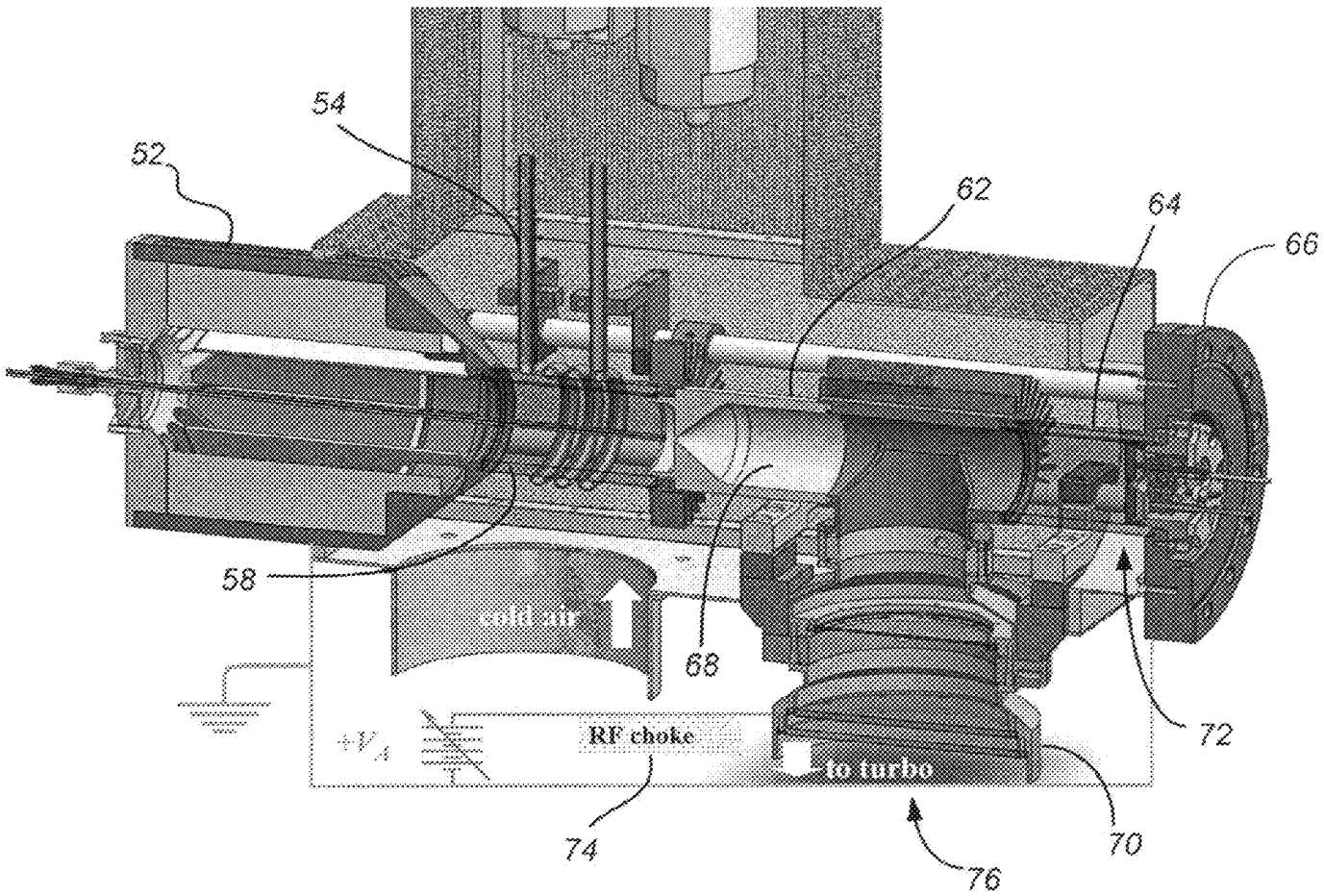
FIG. 4 is an illustrative view showing the construction of the apparatus of FIG. 3 according to certain embodiments of the disclosure.

FIG. 4 is an illustrative view showing the construction of the apparatus of FIG. 3 according to certain embodiments of the disclosure. In some embodiments, the NB-NEP apparatus 50, as discussed above, may comprise a positive DC bias voltage ($+V_A$) accelerator 70 having a pumping neutralizer 76, a first plasma dielectric or ICP quartz tube 58 acting as a first plasma generator chamber, an injector dielectric or NEP quartz tube 62 including an injector 68 coupled to the accelerator 70, an RF (radio frequency) choke 74 configured to regulate the accelerator 70, a second plasma (NEP) quartz tube 64 acting as a second plasma generator chamber disposed adjacent a neutralizer grid 72. Pumping neutralizer 76 may include a three-grid configuration to neutralize the plasma prior to the plasma reaching the TMP (not shown). Alternatively, neutralizer grid 72 may be replaced with either a wafer substrate/sample or energy analyzer. The accelerator 70 may be configured to be substantially cylindrical and comprising a conductive material.

TABLE 1

| Plasma | Gas | Pressure | Power | $V_{fm}$ | $V_P$ | $V_{fB}$ | EEDƒ | IEDƒ |
|---|---|---|---|---|---|---|---|---|
| ICP | Ar | 20 mTorr | 150 W | ~10 V | ~25 V | NA | NA | NA |
| NEP | $N_2$ | 2 mTorr | 700 V × 500 mA | ~300 V | 700 V | ~280 V | Confirmed | Confirmed |

As shown in Table 1, the end-boundary floating-surface sheath potential, electron and ion energy distribution functions (EEDƒ, IEDƒ) in a low-pressure non-ambipolar electron plasma (NEP) or second plasma are investigated. The NEP may be heated by an electron beam extracted from an inductively coupled electron-source plasma (ICP) or first plasma through the injector dielectric 62 by the accelerator 70 located inside the NEP. The NEP's EEDƒ may have a Maxwellian bulk followed by a broad energy continuum connecting to the most energetic group of energies around plasma beam energy. The NEP pressure may be 1 to 3 mTorr of $N_2$ and the ICP pressure may be 5 to 20 mTorr of Ar. The accelerator 70 may be biased positively ($+V_A$) from 80 to 700V and the ICP power range may be 150 to 300 W. The NEP EEDƒ and IEDƒ may be determined using a retarding field energy analyzer, for example. The EEDƒ and IEDƒ may be measured at various NEP pressures, ICP pressures and powers as a function of accelerator voltage ($+V_A$). The accelerator current and sheath potential may also be measured. The IEDƒ may reveal mono-energetic ions with adjustable energy and the IEDƒ may be proportionally controlled by the sheath potential. The NEP end-boundary floating surface may be bombarded by a mono-energetic, space-charge-neutral plasma beam (see FIG. 10 at 80). When the injected energetic electron beam is adequately dampened by the NEP, the sheath potential may be linearly controlled at almost a 1:1 ratio by the accelerator voltage ($+V_A$). If the NEP parameters cannot dampen the electron beam sufficiently, leaving an excess amount of electron-beam power deposited on the floating surface, the sheath potential will collapse and become unresponsive to the accelerator voltage ($+V_A$).

It should be noted that the second plasma (NEP) may be set up to run in a highly stable manner for hours at a time without any off intervals between 5 millitorr (mTorr) to 1 mTorr. In Table 1, $V_{fM}$ is the isotropic floating potential, that is, not under the neutral beam (NB), and $V_{fB}$ is the floating potential under the NB.

Figure 5:
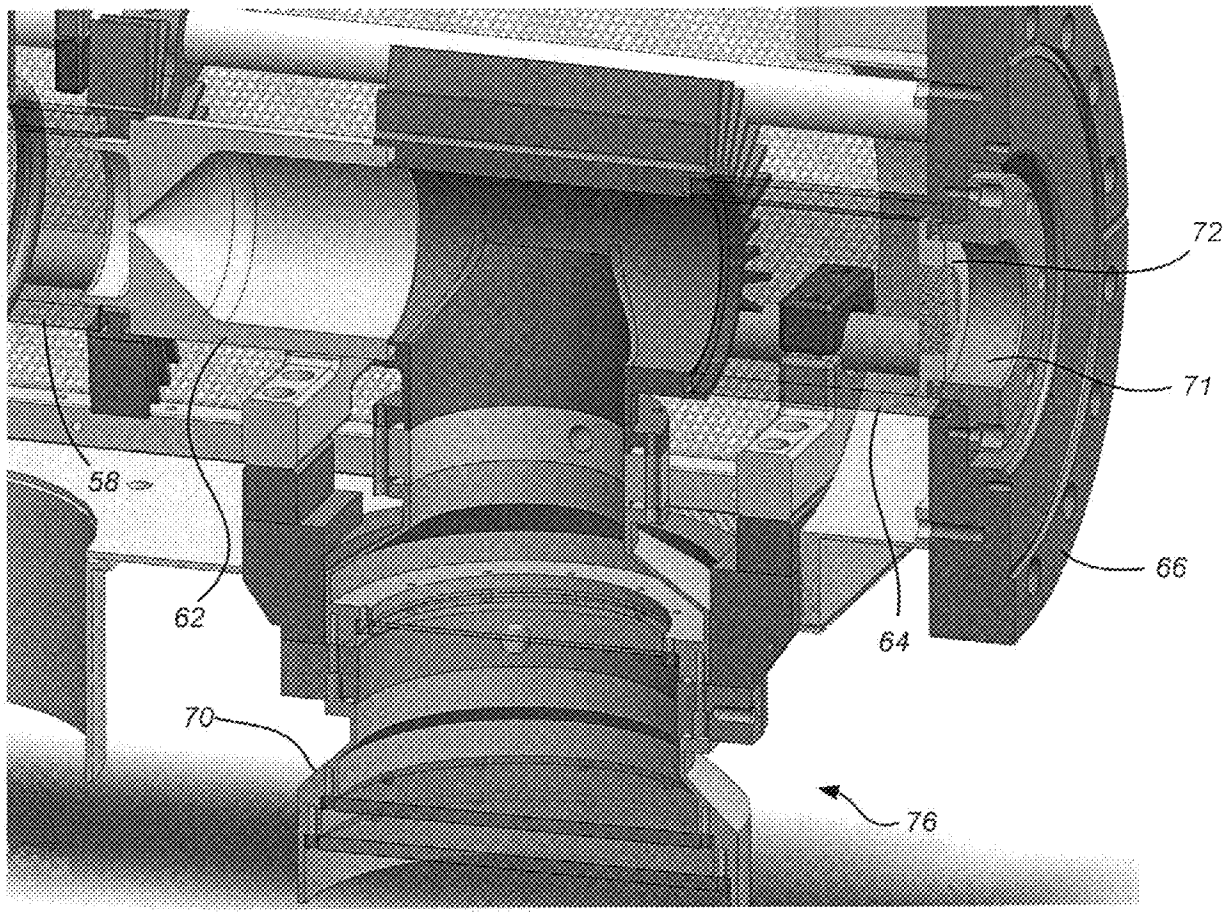
FIG. 5 is a schematic view of the apparatus of FIG. 3 according to certain embodiments of the disclosure.

FIG. 5 is a schematic view of the apparatus 50 of FIG. 3 according to certain embodiments of the disclosure. Neutralizer grid 72 may be configured as an insulator. It should be noted that the entire NEP region which includes injector dielectric tube 62 and second plasma (NEP) dielectric tube 64 being configured not to have any electric ground. Therefore, dielectric neutralizer grid 72 is not grounded as well. In other words, the NEP region is isolated from the electrical ground of ground mounting flange 66 by the insertion of dielectric grid holder 71 configured to hold the dielectric neutralizer grid 72 apart from ground. Dielectric neutralizer grid 72 may be configured to have a dielectric surface material selected from the group consisting of quartz, ceramic, $SiO_2$, aluminum oxide, $HfO_2$, $Y_2O_3$, for example.

Dielectric grid holder 71 may comprise Ultem (polyimide) and the like. A purpose of the dielectric grid holder 71 is to make sure that the NEP (second plasma) does not come in contact with any electrical ground-surface but only touches/contacts the dielectric neutralizer grid 72. Further, accelerator may be configured to include, for example, a three-grid pumping neutralizer 76 at a positive DC bias voltage ($+V_A$).

Figure 6:
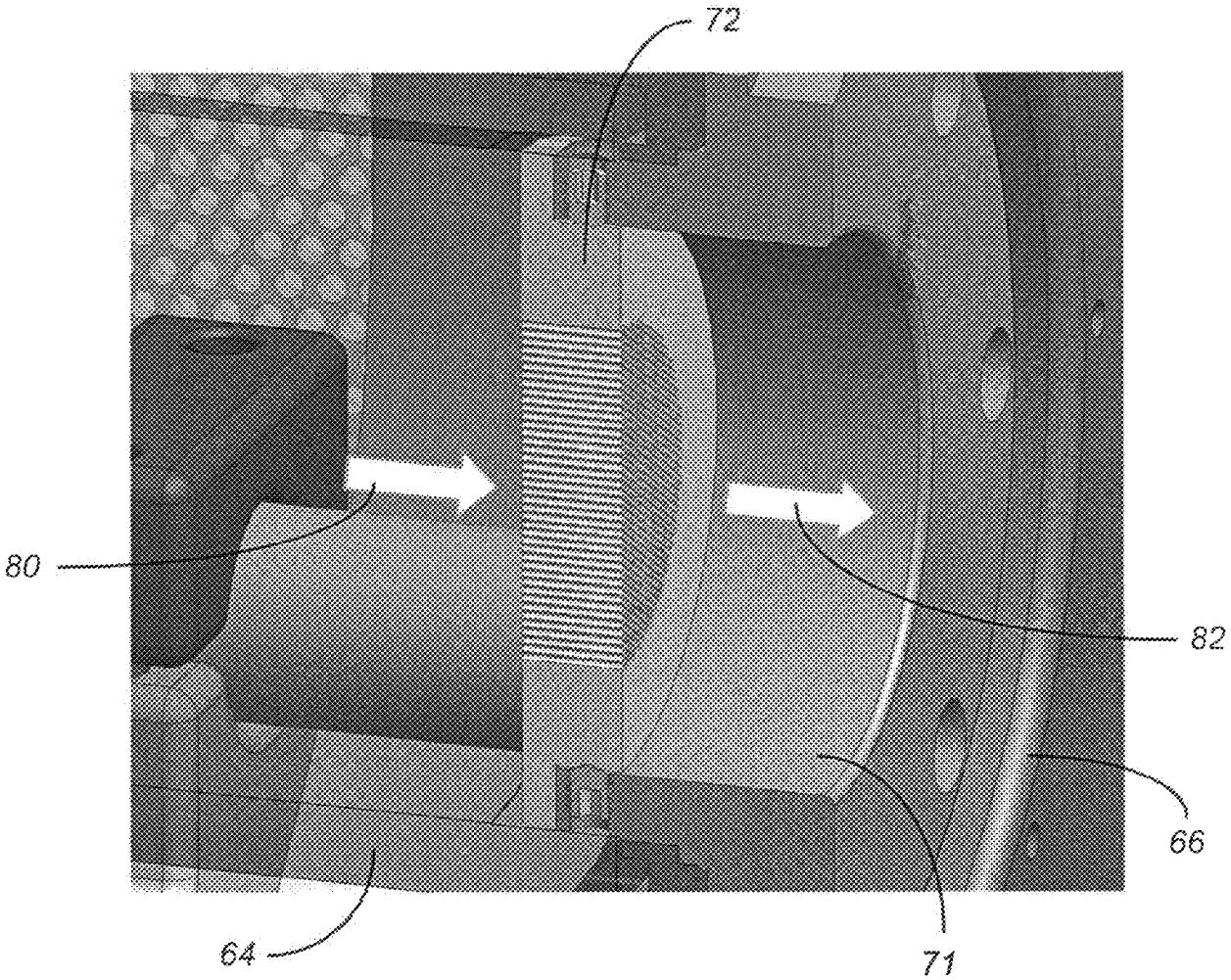
FIG. 6 is an enlarged schematic view of a cross-section of a dielectric neutralizer region of the apparatus of FIG. 3 according to certain embodiments of the disclosure.

FIG. 6 is an enlarged schematic view of a cross section of a dielectric neutralizer region of the apparatus of FIG. 3 according to certain embodiments of the disclosure. In FIG. 6, neutralizer grid 72 may be disposed between a NEP quartz tube wall 64 and a grid holder 71. In FIG. 6, a space-charge-neutral plasma beam 80 comprising a substantially anisotropic beam of neutral particles is introduced into the neutralizer grid 72 and exits as a neutral beam 82 to etch or treat a wafer substrate (not shown, downstream). Neutralization may occur when a surface recombination of electrons and positive ions occurs on the inner surface of high aspect ratio, for example, >5 or >15 ratio, tubes of the neutralizer grid 72. Through forward scattering of the positive ions on these tubes' inner surfaces and recombining these positive ions with surface electrons, neutralization may occur (see FIGS. 8A and 8B).

Figure 7:
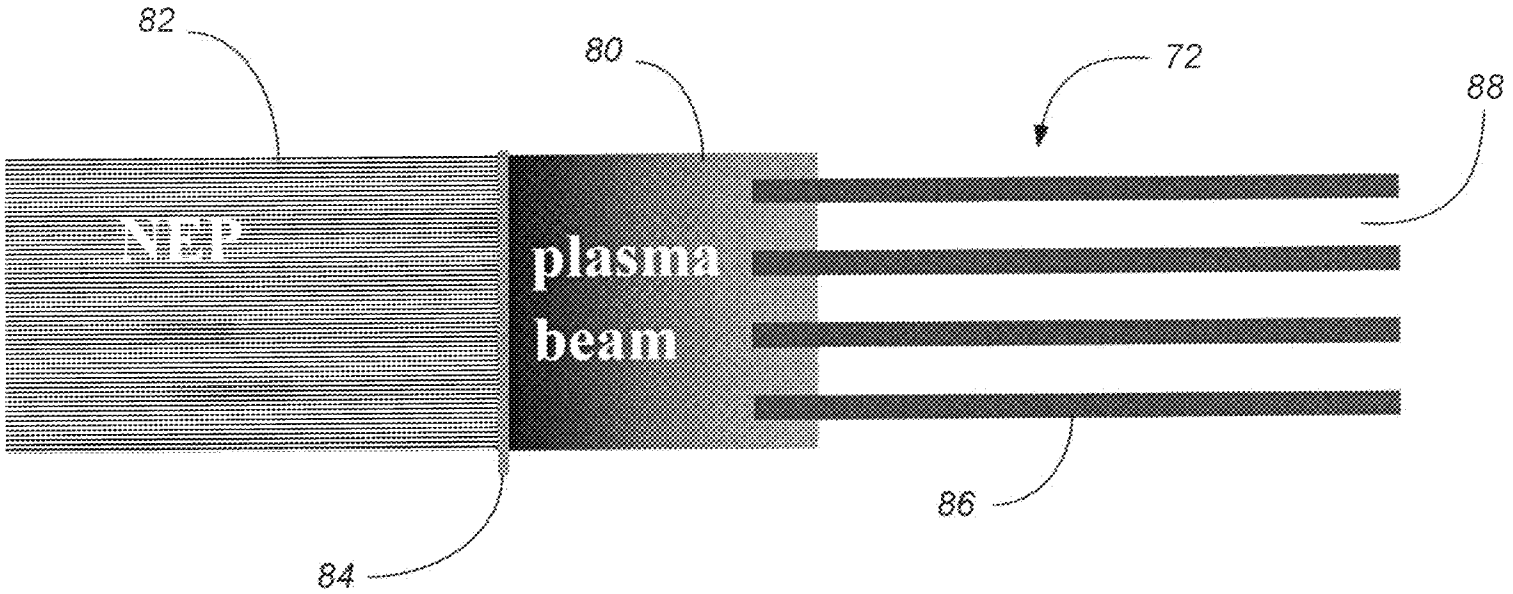
FIG. 7 is schematic side view of the non-ambipolar electron plasma and neutral beam at a dielectric neutralizer grid according to certain embodiments of the disclosure.

FIG. 7 is schematic side view of the NEP (second plasma) and neutralizer grid 72 according to certain embodiments of the disclosure. In FIG. 7, the NEP (second plasma) is shown in contact with the high aspect ratio quartz neutralizer grid 72 and its tube channel 88 and tube wall 86 configurations. It should be noted that the plasma beam 80 may take shape, as shown, after the sheath edge 84.

Figure 8A:
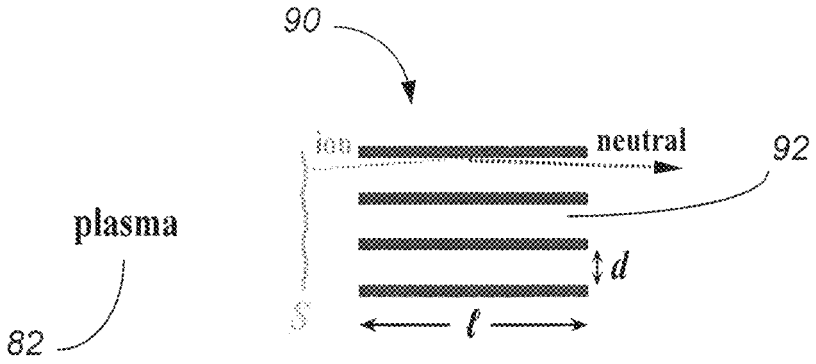
FIGS. 8A and 8B are schematic side views of channels of the neutralizer grid of FIG. 6 with varying sheath ratios.
Figure 8B:
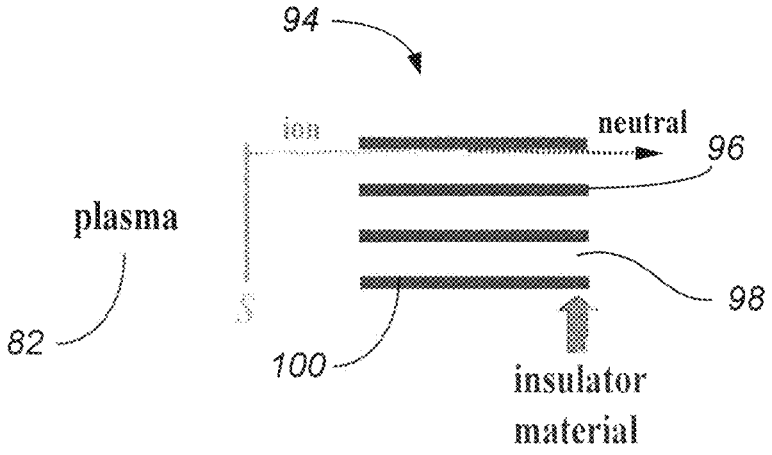

FIGS. 8A and 8B are schematic side views of holes or channels 92, 98 of the ungrounded dielectric neutralizer grid of FIG. 6 with varying sheath ratios when acted upon by NEP 82. In FIG. 8A, the neutralizer grid 90 having, for example, an S~2d and a high l/d tube channel >5 ratio, may include a neutralizer individual grid hole 92. In FIG. 8B, the neutralizer grid 94 having, for example, an S>2d and a high l/d tube channel >15 ratio, may include a neutralizer tube surface 96, a neutralizer tube channel 98, and a neutralizer top surface 100. Each neutralizer grid may be configured to have a ratio l/d, where l is the cross sectional length of the neutralizer tube channel 98 and d is the length as measured between the neutralizer top surface 100 and tube surface 96, that is, the neutralizer grid's individual grid hole 92 or opening. Neutralizer tube channels 98 may be configured as a plurality of channels oriented perpendicular to a surface of the substrate.

It should be noted that sub-Debye grid hole (d<S) may be configured to prevent the sheath S from molding into the grid hole 92 and ensures a grazing angle (see FIGS. 8A and 8B at ion and neutral) interaction between the incident ion and the tube surface 96 resulting in a high degree of directionality for the emerging fast-neutral: (1) For a ratio of >5, for example S~2d sub-Debye neutralizer configuration may keep a fairly flat sheath S over the grid hole 92 ensuring straight, fast neutrals; high l/d tube channel >5 having the benefits of a large tube surface for neutralization and being able to filter out any off-axis rogue fast-neutrals; and (2) For a ratio of >15, for example S>2d sub-Debye neutralizer configuration may ensure a flat sheath S over the grid hole 92, together with a high l/d tube channel approximately >15 having a geometry which may optimize the mono energy, directionality, and neutralization efficiency of the plasma beam 80.

In other words, grid hole 92 may be configured to be sub-Debye (for example, S>2d) and the tube channel 98 may be configured with a high aspect ratio (for example, l/d~>15) to ensure a highly direction fast neutral beam (anisotropic energetic NB). Unlike the conventional version of the mono-energetic NB (see FIG. 1), the mono-energetic NB-NEP apparatus 50 utilizes the space-charge-neutral plasma beam for surface neutralization. Thus, as the equal-number-electron-ion plasma beam enters the tube channel, the tube-surface electron recombines with the grazing-angle forward-scattering ion forming the neutral beam. Its sheath does not have an electron-free region and its neutralizer grid 72 does not supply any electrons, that is, the neutralizer grid's neutrality has been predetermined by the space-charge-neutral plasma beam.

Figure 9:
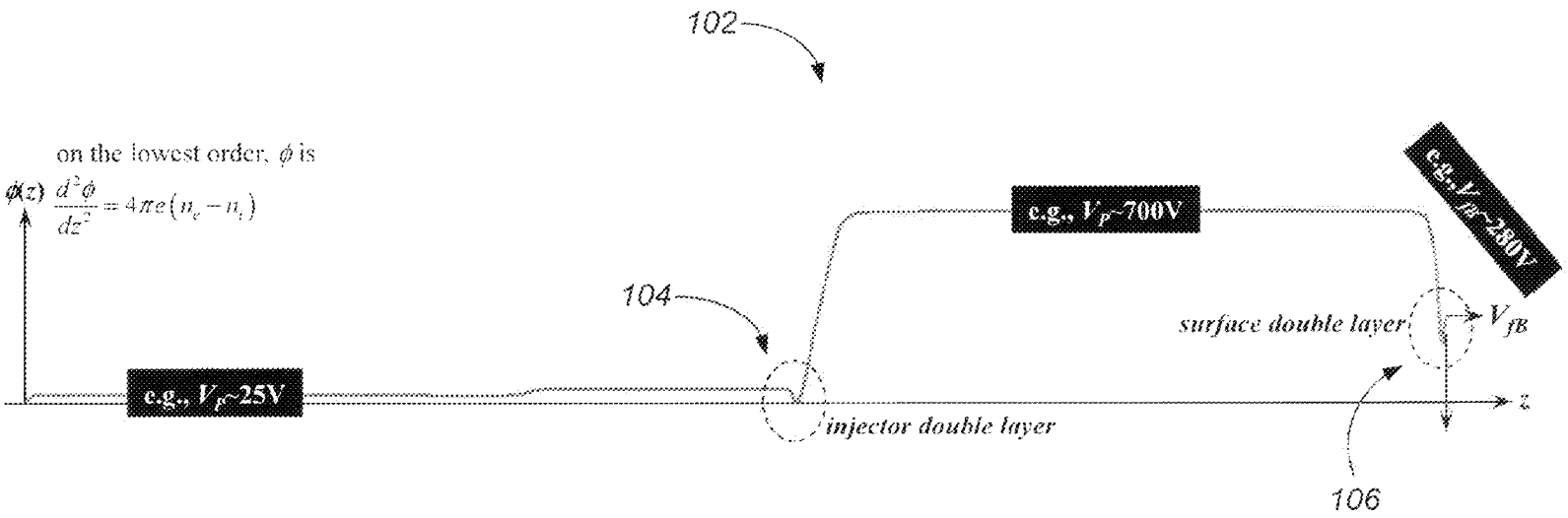
FIG. 9 is a graphical plot of a potential diagram of the apparatus of FIG. 3 according to certain embodiments of the disclosure.

FIG. 9 is a graphical plot of a potential diagram 102 of the apparatus of FIG. 3 according to certain embodiments of the disclosure. In FIG. 9, the potential structure depicts a surface double layer 106 at the NEP end-boundary and an injector double layer 104 at the injector 68 of FIG. 3. The surface double layer 106 has not yet been experimentally probed. Its existence/prediction is a very plausible theory. However, it must be noted here that the existence or nonexistence of the surface double layer is inconsequential to the design of the dielectric neutralizer grid 72 for the NB-NEP apparatus 50. In FIG. 9, a first plasma (ICP) may have a first plasma potential approximately 25V, a second plasma (NEP) may have a second plasma potential approximately 700V, and a floating potential ($V_{fB}$) under the NB-NEP apparatus 50 beam may be approximately 280V, for example. Further, the DC bias potential of the accelerator 70 may also be approximately 700V. Thus, the second plasma potential may approximately be equal to the DC bias potential of the accelerator 70.

In addition, the first plasma may be held at a controlled pressure via the TMP: $P_1$, where $1\times10^{-5}<P_1<1\times10^{-1}$ Torr in the first plasma dielectric chamber 58. The second plasma may be held at a controlled pressure also via the TMP: $P_2$, where $1\times10^{5}<P_2<1\times10^{-2}$ Torr in the second plasma chamber 64.

Figure 10:
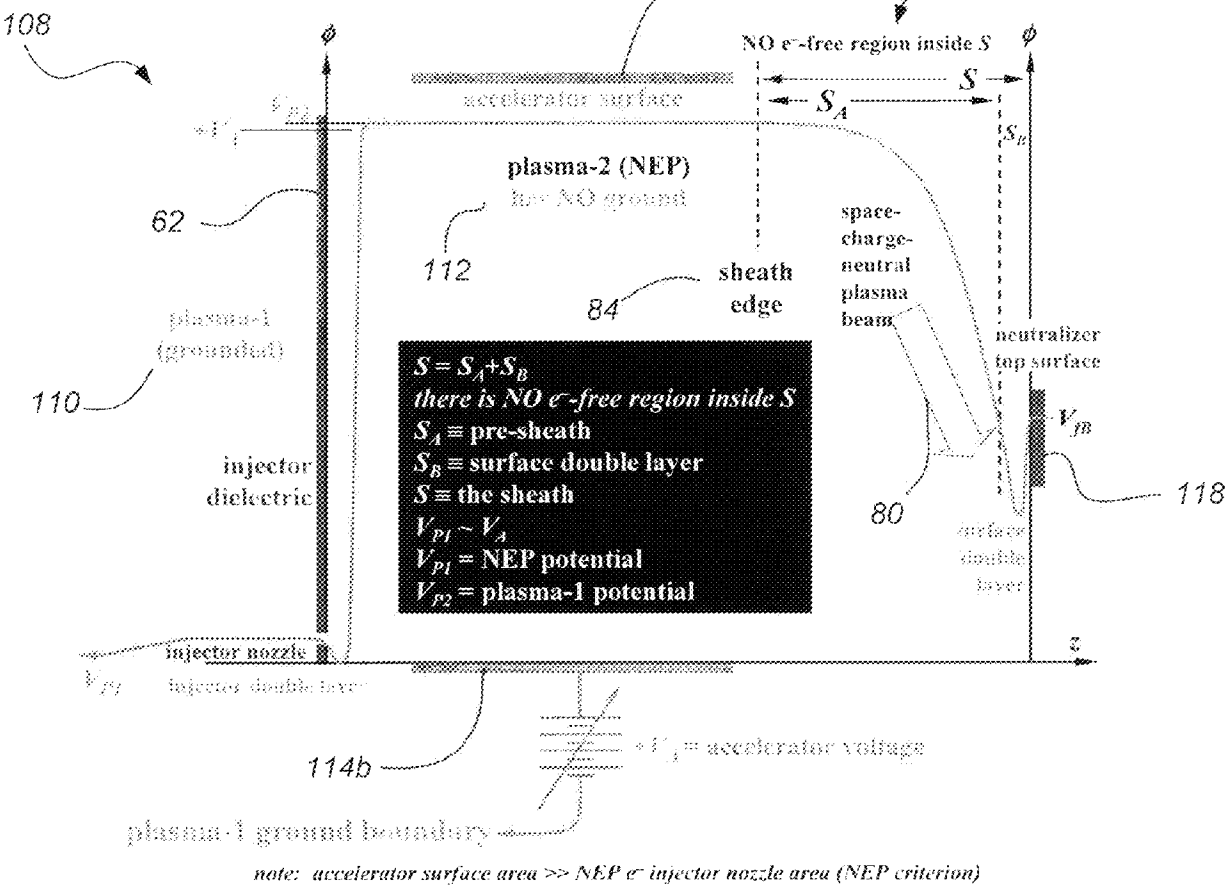
FIG. 10 is a graphical plot showing a potential diagram and geometry of an injector dielectric, an accelerator, and an ungrounded neutralizer grid top surface according to certain embodiments of the disclosure.

FIG. 10 is a graphical plot showing a potential diagram 108 of an injector dielectric 62, accelerator surfaces 114*a*, 114*b* of accelerator 70, and an ungrounded neutralizer grid top surface 118 of neutralizer grid 72 of FIG. 3 according to certain embodiments of the disclosure. FIG. 10 shows the potential structure and the design of the dielectric neutralizer grid 72 for the NB-NEP apparatus 50. In certain embodiments, neutralization by ion and electron recombination at the tube surface 118 of the neutralizer grid 72 followed by forward scatter of these particles, largely preserves the initial ion velocity, and an equal number of electrons and positive ions in the plasma beam 80 and a recombination neutralization on the tube surface 96 of the neutralizer grid 72 conserves energy and momentum of the particles. In other words, with the neutralizer grid 72 configured to be ungrounded, positive ions are not lost in the plasma beam 80. It should be noted that the accelerator surface area is substantially larger than the NEP electron injector nozzle area (NEP criterion) as shown in FIG. 10.

Further, in certain embodiments an equal number of electrons and positive ions in the plasma beam 80 formed at the sheath edge 84 recombine and neutralize on the tube surface 96 thereby conserving energy and momentum.

Figure 11A:
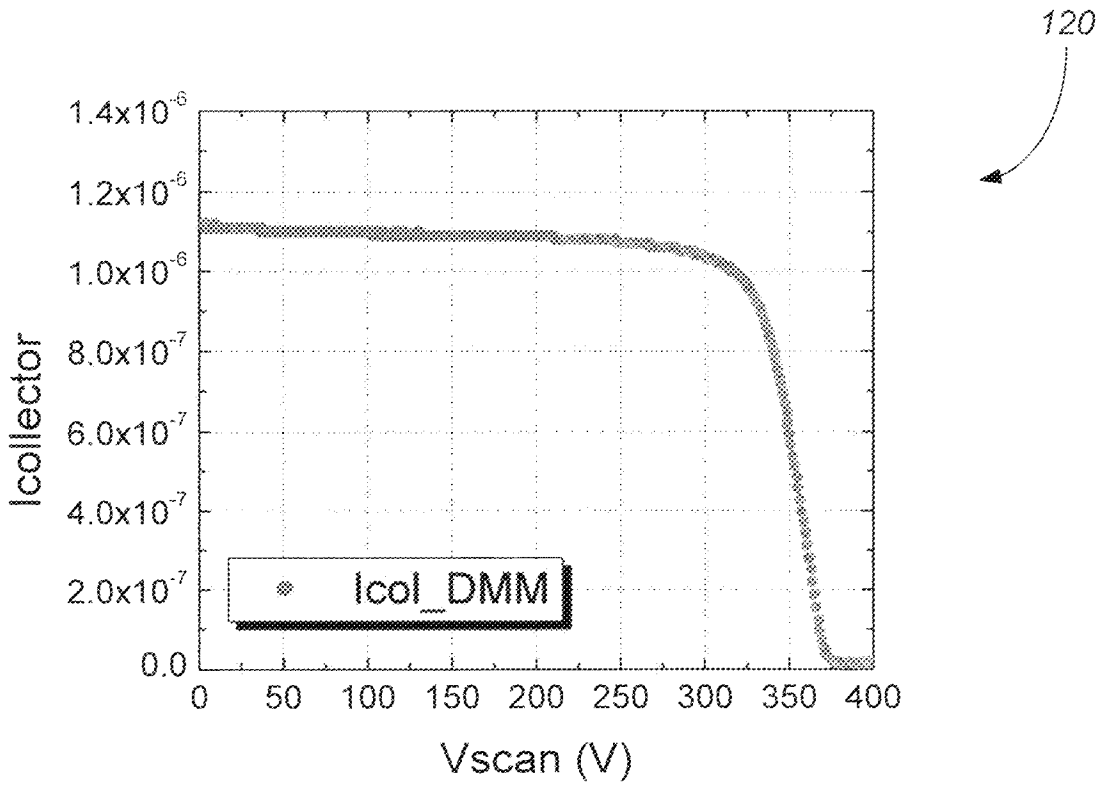
FIGS. 11A and 11B are graphical plots of the ion energy distribution (IED) measured at the NEP end-boundary according to certain embodiments of the disclosure.
Figure 11B:
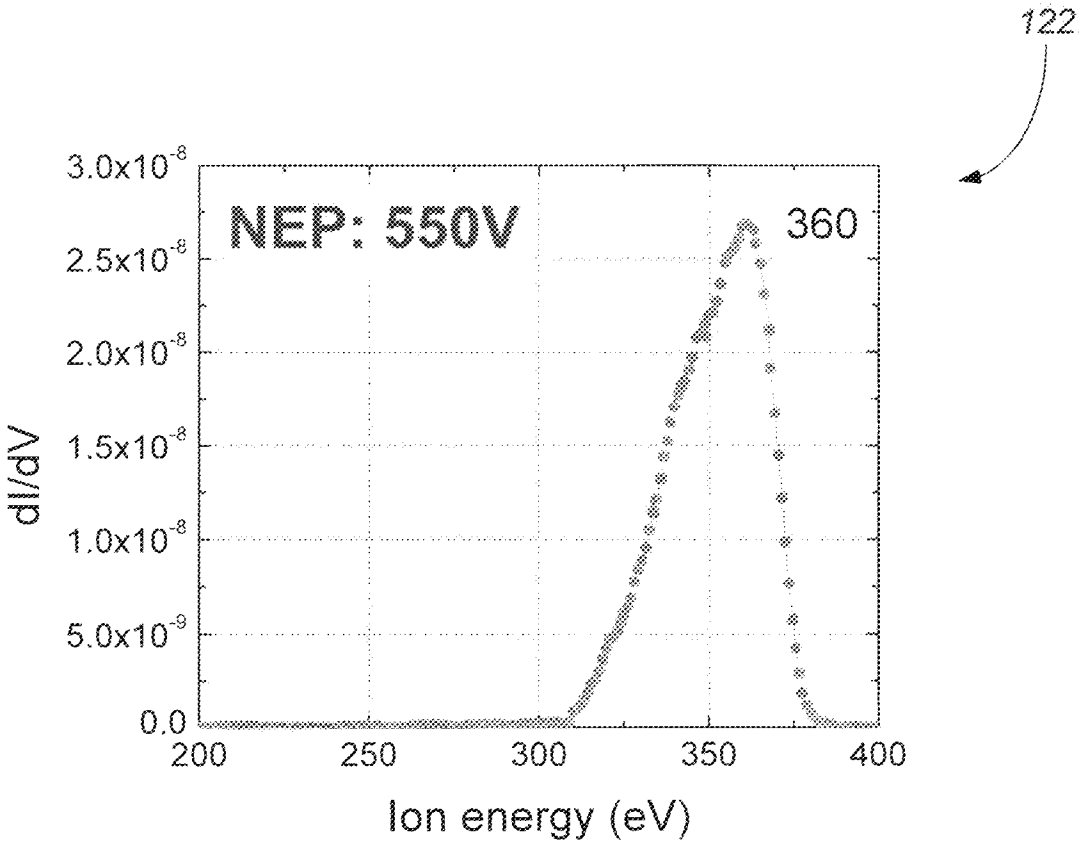

FIGS. 11A and 11B are graphical plots of the ion energy distribution (IED) measured at the NEP end-boundary according to certain embodiments of the disclosure. FIGS. 11A and 11B show an example of the IED*f* measured at the NEP end-boundary. In certain embodiments, a space-charge-neutral plasma beam 80 comprising a substantially anisotropic beam of neutral particles, bombards the NEP end-boundary (again, an insulating surface). For example, the accelerator voltage may be $V_A$=550V, which is also the NEP plasma potential, $V_{P2}$~$V_A$. The measured ion energy peak is at 360 eV which is $V_{P2}-V_{fB}$, where $V_{fB}$ is the insulator surface floating potential under the bombardment of the beam 80. The plasma beam's electron energy bombarding the end-boundary is $V_{fB}-V_{P1}$ ($V_{P1}$ is first plasma potential which is typically approximately 20V) which is approximately 190 eV.

The NB-NEP apparatus 50 of FIG. 3 may be used for anisotropic etching of copper according to certain embodiments of the disclosure. The etch reagent gas may be an organic compound gas. As for the organic compound, it is preferable to use one that can be supplied as it is or in a gaseous state by heating to the plasma processing system maintained in a vacuum state. Typically, an organic acid is used. As for the organic acid, it is preferable to use a carboxylic acid represented by an acetic acid (general formula: R—COOH, R being hydrogen or straight-chain or branched-chain alkyl or alkenyl of C1 to C20, preferably methyl, ether, propyl, butyl, pentyl, or hexyl). The carboxylic acid other than the acetic acid may include formic acid (HCOOH), propionic acid ($CH_3CH_2COOH$), butyric acid ($CH_3(CH_2)_2COOH$), valeric acid ($CH_3(CH_2)_3COOH$) or the like. Among the carboxylic acids, the formic acid, the acetic acid, and the propionic acid are more preferably used.

When the organic compound is acetic acid, the reaction between copper oxide and acetic acid is accelerated, and volatile $Cu(CH_3COO)$ and $H_2O$ are generated. As a consequence, copper oxide molecules are separated from the Cu film. The same reaction occurs in the case of using another organic compound (organic acid) such as formic acid or propionic acid other than acetic acid. As a result, the Cu film is etched.

Figure 12:
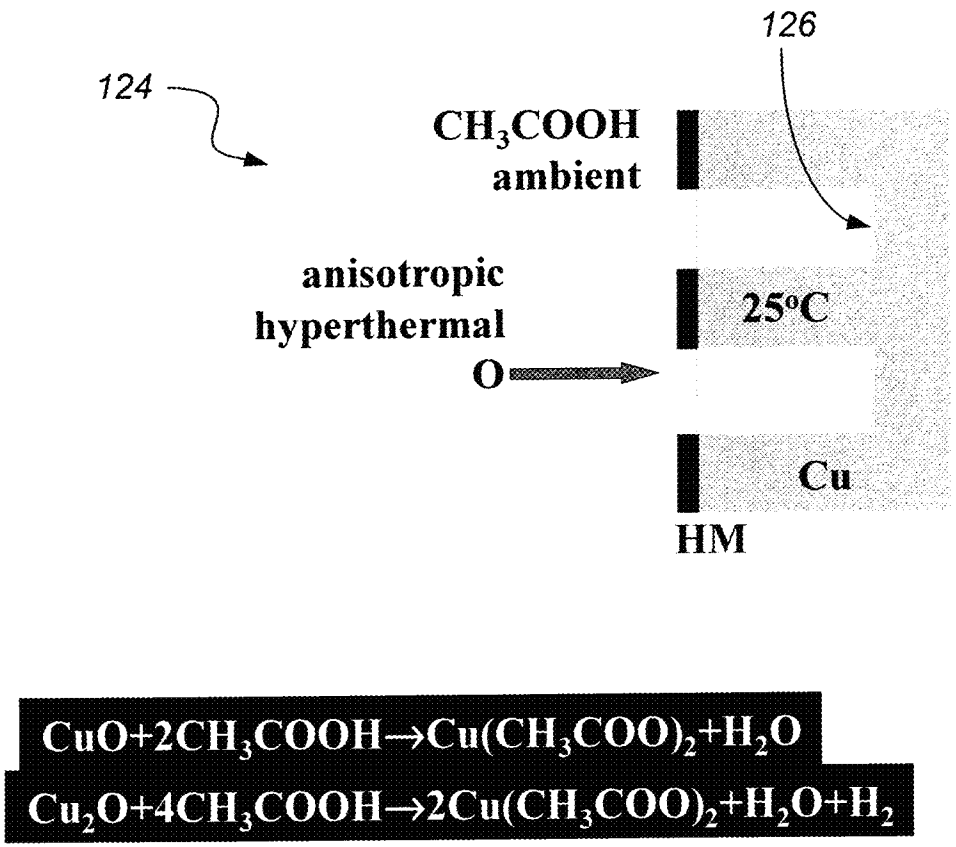
FIG. 12 is a schematic view of an example application using the apparatus of FIG. 3 according to certain embodiments of the disclosure.

FIG. 12 is a schematic view of an example application 124 using the NB-NEP apparatus 50 of FIG. 3 according to certain embodiments of the disclosure. In FIG. 12, embodiments of the disclosure are applied to treat a Cu based substrate, $CH_3COOH$, for Cu anisotropic dry-etching. For example, at ambient the substrate is placed at 25° C. and $3\times10^5$ Torr. When an anisotropic hyperthermal oxygen (O) based treatment is applied at, for example, at 100 eV, $Cu_xO$ is formed at 126 by the sub-plantation of the anisotropic hyperthermal oxygen (O) during etching. The net surface reactions between $CH_3COOH$ and oxidized Cu can be written as:

$$CuO+2CH_3COOH\rightarrow Cu(CH_3COO)_2+H_2O \quad (1)$$

$$Cu_2O+4CH_3COOH\rightarrow 2Cu(CH_3COO)_2+H_2O+H_2 \quad (2)$$

According to Eqs. (1) and (2), $CH_3COOH$ reacts with oxidized Cu and forms Cu, and volatile $Cu(CH_3COO)_2+H_2O$ etching products. Therefore, when $CH_3COOH$ is selected as an etch reagent, the volatile etch products are $Cu(CH_3COO)_2$ and $H_2O$).

Transport of the gaseous $CH_3COOH$ etching gas to the processing chamber may be achieved using a delivery system that can comprise a bubbler system and a mass flow controller (MFC). The bubbler system can be used with or without a carrier gas such as argon (Ar). When a carrier gas is used, it is bubbled through the $CH_3COOH$ liquid and becomes saturated with the $CH_3COOH$ vapor. The partial pressure of the $CH_3COOH$ vapor in the process chamber is controlled by the temperature of the $CH_3COOH$ liquid in the bubbler. Exemplary gas flow rates of $CH_3COOH$ and a carrier gas are less than 1000 sccm, preferably being less than 500 sccm. Alternatively, a liquid injection system can be used to deliver the $CH_3COOH$ to the processing chamber. The handling and use of etch reagents such as $CH_3COOH$ reagents is well known in the art.

In other words, a substrate may be disposed which includes disposing the substrate having a copper (Cu) layer underlying a patterned mask and etching features in the copper layer, for example. Further, the etching may include etching one or more features on the substrate using the substantially anisotropic beam of neutral particles. An inert gas can be added to any one of the aforementioned process gas chemistries. The inert gas may include at least one of argon, helium, krypton, xenon, and nitrogen. For example, the addition of inert gas to the process chemistry is used to dilute the process gas or adjust the process gas partial pressure(s).

Alternatively, some embodiments of the disclosure may be applied to treat or etch other materials, such as a Ruthenium (Ru) via the NB-NEP apparatus 50. Ru etching may be performed by an oxygen ion beam of the NB-NEP apparatus 50 in an ethanol ($C_2H_6O$) ambient environment.

Figure 13:
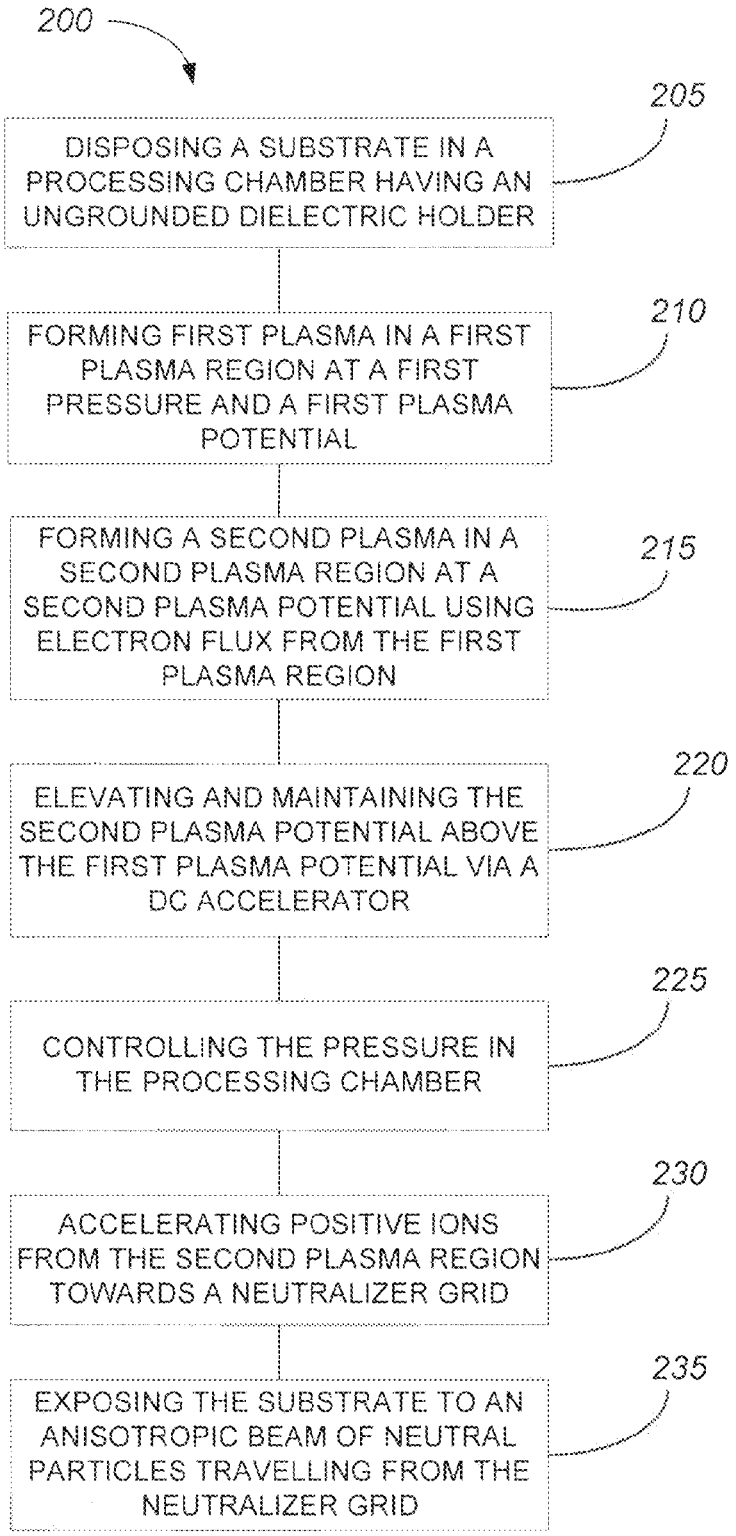
FIG. 13 is a flow chart illustrating a method of operating a plasma processing apparatus configured to treat a substrate according to certain embodiments of the disclosure.

FIG. 13 is a flow chart 200 illustrating a method of operating a chemical processing apparatus 50 configured to treat a substrate according to certain embodiments of the disclosure. In FIG. 13, flow chart 200 includes at 205 with disposing a substrate in a chemical processing apparatus 50 configured to facilitate the treatment of the substrate using plasma. The plasma processing chamber (at 58, 62, 64) may include components of the chemical processing apparatus 50 described in FIGS. 3-10, and as indicated above.

At 210, a first plasma is formed from a first process gas in a first plasma region at a first plasma potential, for example 25V. As illustrated in FIGS. 3, 4, and 9, the first plasma region may be located in a plasma generation chamber (at 58, 62, 64), and a plasma generation apparatus (at 54) may be coupled to the plasma generation chamber (at 58, 62, 70) in order to form the first plasma. The first process gas may include flowing a gas comprising argon (Ar) into the first plasma region (at 58).

At 215, a second plasma is formed in a second plasma region (at 62, 64) at a second plasma potential, for example 700V, using electron flux from the first plasma region (at 58). As illustrated in FIGS. 3-10, the electron flux from the first plasma in the first plasma region (at 58) passes from the plasma generation chamber (at 58, 62, 70) through an injector dielectric 62 to a process chamber or second plasma dielectric tube/chamber 64 where the substrate is to be treated. As illustrated in FIGS. 3, 5, and 6, the second plasma region (at 58) may be located in a process chamber (at 64), wherein one or more openings or passages (at 88) in the neutralizer grid 72 disposed between the plasma generation chamber (at 58, 62, 70) and the process chamber (at 64) facilitates the transport or supply of electrons from the first plasma region (at 58) to the second plasma region (at 62, 64). Where the second plasma (NEP) may be formed by flowing a second process gas which may include flowing oxygen into the second plasma region.

At 220, the second plasma potential is elevated and maintained above the first plasma potential to control the electron flux (see FIGS. 9 and 10). The first plasma in the first plasma region (at 58) may be a boundary-driven plasma, that is, the plasma boundary may have a substantive influence on the respective plasma potential), wherein part or all of the boundary in contact with the first plasma is coupled to DC ground. Additionally, the second plasma in the second plasma region may be boundary-driven plasma, wherein part or the entire boundary in contact with the second plasma is coupled to a DC voltage source at $+V_A$. The elevation of the second plasma potential above the first plasma potential may be performed using any one or combination of embodiments provided in FIGS. 9 and 10.

At 225, gases entering the process chamber are pumped by a vacuum pumping apparatus (TMP) to control a pressure in the process chamber. At 230, an accelerator may be utilized to accelerate as from the second plasma region (at, 62, 64) towards an ungrounded neutralizer grid 72 to recombine electrons and positive ions to make an anisotropic and mono-energetic neutral beam 80. Where accelerating positive ions towards the neutralizer grid 72 includes accelerating positive oxygen ions towards the neutralizer grid 72 having a dielectric surface material selected from the group consisting of $SiO_2$, quartz, aluminum oxide, $HfO_2$, $Y_2O_3$, and the like.

At 235, the substrate is exposed to the anisotropic and mono-energetic neutral beam of the second plasma in the second plasma region (at 62, 64). The exposure of the substrate to the second plasma may comprise exposing the substrate to the anisotropic and mono-energetic neutral beam activated chemical process.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A method for treating a substrate, the method comprising:

disposing a substrate in a chemical processing apparatus configured to treat the substrate with plasma products;

flowing a first process gas at a first pressure into a first plasma region of a plasma generation chamber of the chemical processing apparatus;

maintaining a first plasma in the first plasma region at a first plasma potential;

flowing a second process gas at a second pressure into a second plasma region of the plasma generation chamber;

maintaining a second plasma in the second plasma region at a second plasma potential by using a DC accelerator that maintains the second plasma potential sufficiently greater than the first plasma potential such that the second plasma potential causes an electron flux from the first plasma region towards the second plasma region, the second plasma being maintained using the electron flux from the first plasma region, the second plasma region being separated from the first plasma region via a separation member disposed there between, the separation member defining an array of openings sufficient to allow the electron flux from the first plasma region to the second plasma region;

accelerating positive ions from the second plasma region towards a neutralizer grid disposed between the substrate and the second plasma region, the positive ions being accelerated by maintaining the second plasma such that the second plasma has a potential drop across a sheath boundary adjacent to the neutralizer grid, the neutralizer grid defining a plurality of channels oriented perpendicular to a surface of the substrate, a surface material of the plurality of channels being a material that temporarily holds electrons from the electron flux on surfaces of the plurality of channels such that positive ions traveling through the neutralizer grid receive electrons from the surfaces of the plurality of channels and continue traveling toward the substrate as a neutral particle; and exposing the substrate to a substantially anisotropic beam of neutral particles traveling from the neutralizer grid.

2. The method of claim 1, wherein exposing the substrate to the substantially anisotropic beam of neutral particles includes etching one or more features on the substrate.

3. The method of claim 1, wherein flowing the second process gas includes flowing a gas selected from the group consisting of $O_2$ and $N_2$.

4. The method of claim 1, wherein accelerating positive ions from the second plasma region toward the neutralizer grid includes the neutralizer grid selected from the group consisting of SiO2, quartz, $HfO_2$, $Y_2O_3$, and aluminum oxide.

5. The method of claim 1, wherein maintaining the first plasma at a first plasma potential includes using an inductive coil configured to inductively couple power from a power source to the first process gas in said first plasma region.

6. The method of claim 1, wherein maintaining the first plasma at a first plasma potential includes using a plasma source selected from the group consisting of capacitively coupled plasma (CCP) source, inductively coupled plasma (ICP) source, transformer coupled plasma (TCP) source, surface wave plasma source, helicon wave plasma source, and electron cyclotron resonance (ECR) plasma source.

7. The method of claim 1, wherein using the DC accelerator includes the DC accelerator being substantially cylindrical and comprised of a conductive material.

8. The method of claim 1, wherein accelerating positive ions from the second plasma region toward the neutralizer grid includes the channels in the plurality of channels in the neutralizer grid have a length to width ratio greater than 5.

9. The method of claim 8, wherein accelerating positive ions from the second plasma region toward the neutralizer grid includes the channels in the plurality of channels in the neutralizer grid have a length to width ratio greater than 15.

10. A method for treating a substrate, the method comprising:

disposing a substrate in a plasma processing apparatus configured to treat the substrate with plasma products;

flowing a first process gas at a first pressure into a first plasma region of a plasma generation chamber of the plasma processing apparatus;

maintaining a first plasma in the first plasma region at a first plasma potential using a first energy source;

flowing a second process gas at a second pressure into a second plasma region of the plasma generation chamber;

maintaining a second plasma in the second plasma region at a second plasma potential by using a DC accelerator, using the DC accelerator includes maintaining the second plasma potential sufficiently greater than the first plasma potential such that the second plasma potential causes an electron flux from the first plasma region towards the second plasma region, the second plasma being maintained using the electron flux from the first plasma region, the second plasma region being separated from the first plasma region via a separation member disposed there between, the separation member defining an array of openings sufficient to allow the electron flux from the first plasma region to the second plasma region;

controlling power to the DC accelerator such that the second plasma develops a plasma sheath potential that creates a plasma beam directed towards a neutralizer grid disposed between the substrate and the second plasma region, the plasma beam being space-charge-neutral by having approximately equal amounts of electrons and positive ions, the neutralizer grid defining a plurality of channels oriented perpendicular to a surface of the substrate, a surface material of the plurality of channels being a dielectric material that temporarily holds electrons from the plasma beam on surfaces of the dielectric material such that positive ions from the plasma beam traveling through the neutralizer grid receive electrons and continue traveling toward the substrate as a neutral particle; and exposing the substrate to a substantially anisotropic beam of neutral particles traveling from the neutralizer grid.

11. The method of claim 10, wherein exposing the substrate to the substantially anisotropic beam of neutral particles includes etching one or more features on the substrate.

12. The method of claim 10, wherein flowing the second process gas includes flowing a gas selected from the group consisting of $O_2$ and $N_2$.

13. The method of claim 10, wherein the neutralizer grid includes the neutralizer grid selected from the group consisting of $SiO_2$, quartz, $HfO_2$, $Y_2O_3$, and aluminum oxide.

14. The method of claim 10, wherein maintaining the first plasma at a first plasma potential includes using an inductive coil configured to inductively couple power from a power source to the first process gas in said first plasma region.

15. The method of claim 10, wherein maintaining the first plasma at a first plasma potential includes using a plasma source selected from the group consisting of capacitively coupled plasma (CCP) source, inductively coupled plasma (ICP) source, transformer coupled plasma (TCP) source, surface wave plasma source, helicon wave plasma source, and electron cyclotron resonance (ECR) plasma source.

16. The method of claim 10, wherein controlling the DC accelerator includes the DC accelerator comprising a conductive material.

17. The method of claim 10, wherein the neutralizer grid includes the channels in the plurality of channels in the neutralizer grid have a length to width ratio greater than 5.

18. The method of claim 17, wherein the neutralizer grid includes the channels in the plurality of channels in the neutralizer grid have a length to width ratio greater than 15.

19. An apparatus for treating a substrate, the apparatus comprising:

a first plasma chamber for forming a first plasma at a first plasma potential;

a second plasma chamber for forming a second plasma at a second potential greater than the first plasma potential, wherein the second plasma is formed and maintained by using electron flux from the first plasma and being coupled to a DC accelerator;

a separation member disposed between the first plasma chamber and the second plasma chamber, wherein the separation member is configured with an array or openings sufficient to allow the electron flux from the first plasma chamber to enter the second plasma chamber; and a holder disposed adjacent to the second plasma chamber and apart from the separation member, wherein the holder is configured to hold a neutralizer grid defining a plurality of channels oriented perpendicular to a surface of the substrate, a surface material of the plurality of channels being a material that temporarily holds electrons from the electron flux on surfaces of the plurality of channels such that positive ions traveling through the neutralizer grid receive electrons from the surfaces of the plurality of channels and continue traveling toward the substrate as a neutral particle, wherein the neutralizer grid is configured to cause a substantially anisotropic beam of neutral particles traveling from the neutralizer grid via the electron flux.

20. The apparatus according to claim 19, wherein the neutralizer grid includes the channels in the plurality of channels in the neutralizer grid have a length to width ratio greater than 15.

* * * * *